United States Patent [19]

Quiogue

[11] Patent Number: 4,547,841

[45] Date of Patent: Oct. 15, 1985

[54] ADJUSTABLE LUMINAIRE

[75] Inventor: Honesto D. Quiogue, Blacksburg, Va.

[73] Assignee: Harvey Hubbell Incorporated, Orange, Conn.

[21] Appl. No.: 570,963

[22] Filed: Jan. 16, 1984

[51] Int. Cl.[4] ..... F21V 21/26

[52] U.S. Cl. ..... 362/269; 362/427

[58] Field of Search ..... 362/427, 430, 269, 287, 362/270, 275, 277, 285, 362

[56] References Cited

U.S. PATENT DOCUMENTS

| | | | |
|---|---|---|---|
| Re. 17,545 | 12/1929 | Nenzel | 362/269 |
| 932,621 | 8/1909 | Lockwood | 362/269 |
| 1,562,502 | 11/1925 | Gowdy . | |
| 1,610,124 | 12/1926 | Godley . | |
| 1,688,497 | 10/1928 | Hundley | 362/269 |
| 1,800,886 | 4/1931 | Dunlap . | |
| 2,142,467 | 1/1939 | Waterbury . | |
| 2,200,114 | 5/1940 | Konikoff | 362/269 |
| 2,240,785 | 5/1941 | Johnson . | |
| 2,289,160 | 7/1942 | Yost . | |
| 2,327,820 | 8/1943 | Rogers | 362/269 |
| 2,336,119 | 12/1943 | Nettesheim | 362/269 |
| 2,913,570 | 11/1959 | Gough et al. . | |
| 3,179,366 | 4/1965 | Lowell | 362/427 |
| 3,257,553 | 6/1966 | Tolbert . | |
| 3,809,880 | 5/1974 | Daumueller et al. | 240/8.2 |
| 4,173,037 | 10/1979 | Henderson | 362/427 |
| 4,489,368 | 12/1984 | Sangiamo | 362/427 |

OTHER PUBLICATIONS

General Electric Co. Brochure, "High Intensity Discharge Lamps", pp. 22–25 (1975).

Hubbell Lighting Division Brochure (Harvey Hubbell Inc.), "Sportsliter" (1981).

*Primary Examiner*—Ronald H. Lazarus

*Attorney, Agent, or Firm*—Jerry M. Presson; Walter C. Farley

[57] ABSTRACT

A luminaire of an HID lamp includes a wiring box pivotally mounted on a yoke and a lamp and reflector mounted on the box. The lamp is mounted with its axis perpendicular to a normally horizontal surface of the box. The reflector is mostly formed as surfaces of revolution but has a flat mounting surface offset from the reflector axis at a predetermined angle, preferably about 36° for use with a lamp having a ±15° operating angle deviation from vertical. Thus, the aiming angle can be between 21° and 51° from vertical.

1 Claim, 10 Drawing Figures

FIG. 1
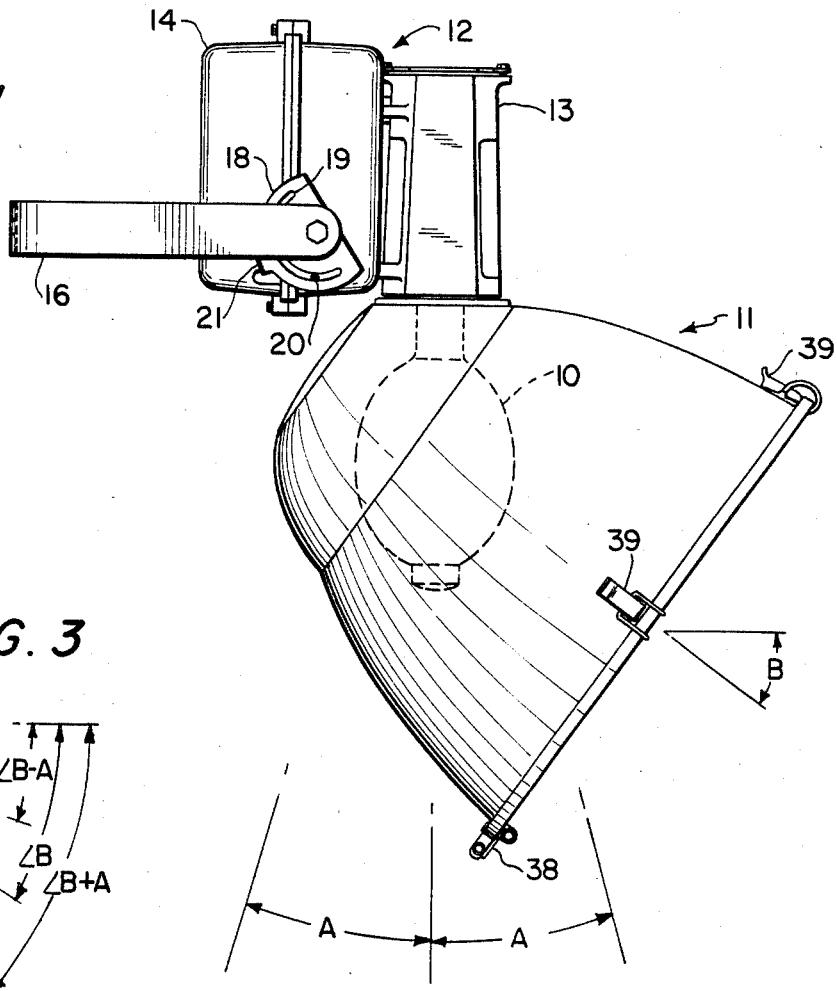
FIG. 3
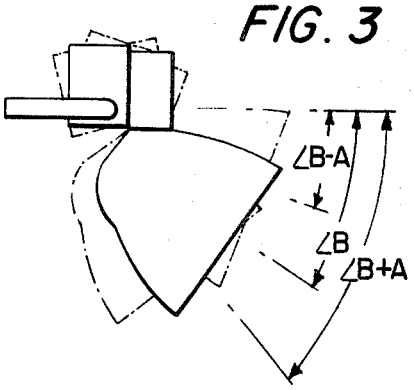
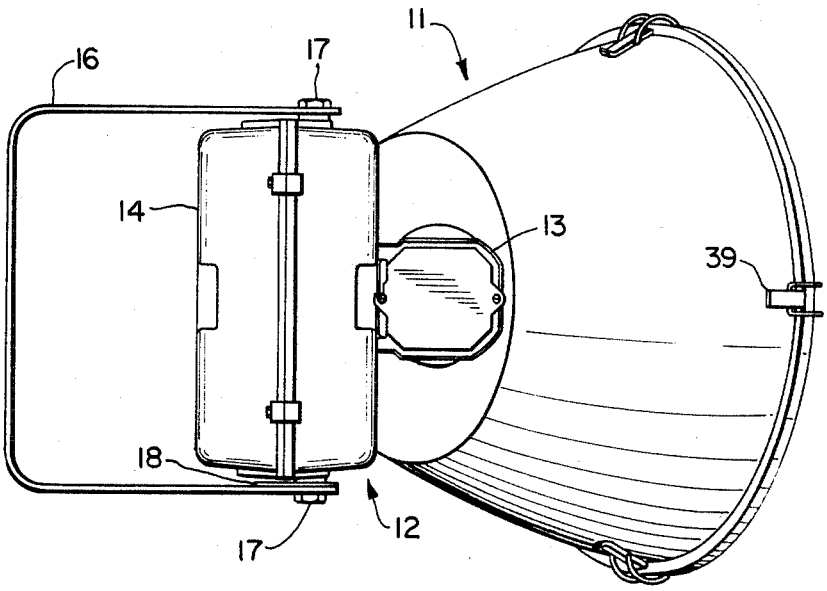
FIG. 2

ADJUSTABLE LUMINAIRE

This invention relates to a reflector and mounting arrangement for a high intensity discharge lamp which permits efficient operation concurrently with directing the light laterally.

BACKGROUND OF THE INVENTION

High intensity discharge lamps, such as metal halide lamps, which are commonly used to illuminate fields and arenas on which sporting events take place, are sensitive to the angle at which they are operated. Such lamps commonly include an arc tube which contains a metal halide and has electrodes which start and maintain an arc within the tube, producing bright light with a color depending upon halide composition and other factors.

One hundred percent light output is normally achieved only when the arc tube is in the vertical position, i.e., with the base of the lamp either up or down but with the long axis of the lamp envelope, which is coincident with the longitudinal axis of the arc tube, in a vertical position. Light output is reduced by as much as 10% at angles between this optimum position and a position in which the arc is inclined by an angle of 45°.

These lamps are very useful for lighting large areas such as interior sports arenas or outdoor fields, and are most useful when they can be employed in tilted sources, i.e., wherein the light from the lamp is adjustably directed at various angles with respect to the horizontal.

All arc-discharge lamps emit light energy as a function of the projected area of the arc. Thus, the magnitude of the energy is greatest in a direction perpendicular to the long axis of the arc and approaches zero in a direction from the ends of the arc. In sports lighting fixtures over the years, this characteristic has dictated the use of reflectors having symmetrical rotations of conic sections, the foci of these sections being coincidental with the center of the arc, which is referred to as the light center in the lighting industry. The result of this geometry is a symmetrical distribution of light energy emitted from the open end of the reflector in a direction perpendicular to the plane of the opening. As this "beam" of light is directed toward areas in a recreational field, the source is necessarily tilted to an angle, typically between 40° and 70° from the vertical.

BRIEF SUMMARY OF THE INVENTION

An object of the present invention is to provide mounting arrangements and reflector configurations which permit flexible use of a metal halide lamp at convenient angles for illuminating areas such as recreational fields and arenas while maintaining the orientation of the arc source within 15° of vertical.

A further object of the invention is to provide adjustable mounting and reflector arrangements which permit efficient use of a high intensity discharge lamp to project light laterally at a range of angles offset from the vertical by amounts greater than the high efficiency mounting angle for the lamp.

Briefly described, the invention includes an improved luminaire for use with high intensity discharge lamps, the luminaire being of the type having a ballast housing, a mounting bracket coupled to said ballast housing, a lamp mounting arrangement on the ballast housing for receiving a lamp with the central axis of the lamp in a predetermined relationship to the mounting and ballast housing, and a generally bowl-shaped, open-ended reflector attached to the lamp mounting, the ballast housing being angularly adjustable relative to said mounting bracket to thereby adjust the tilt of the axis of said lamp. The improvement includes a reflector which has a wall formed such that the interior reflective surface thereof defines at least one surface of revolution and is closed at the smaller end thereof, and further comprises an opening through which a lamp can extend from the lamp mounting means into the reflector with a region around the opening for attaching the reflector to the lamp mounting means. The light center of the lamps is at a focus of the surface of revolution, thereby defining with the reflective surface a primary light projection axis. The opening is located in the reflector wall angularly offset from the primary projection axis of the reflector near the closed end such that an acute angle of preselected size is formed between the primary projection axis and the central longitudinal axis of the lamp, so that the dominant illumination from the luminaire emerges at the preselected angle away from vertical with the lamp axis vertical.

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a side elevation of an adjustable luminaire in accordance with the invention;

FIG. 2 is a top plan view of the luminaire of FIG. 1;

FIG. 3 is a schematic illustration of the range of adjustability of the luminaire of FIGS. 1 and 2;

DETAILED DESCRIPTION OF THE DRAWINGS

Figure 4:
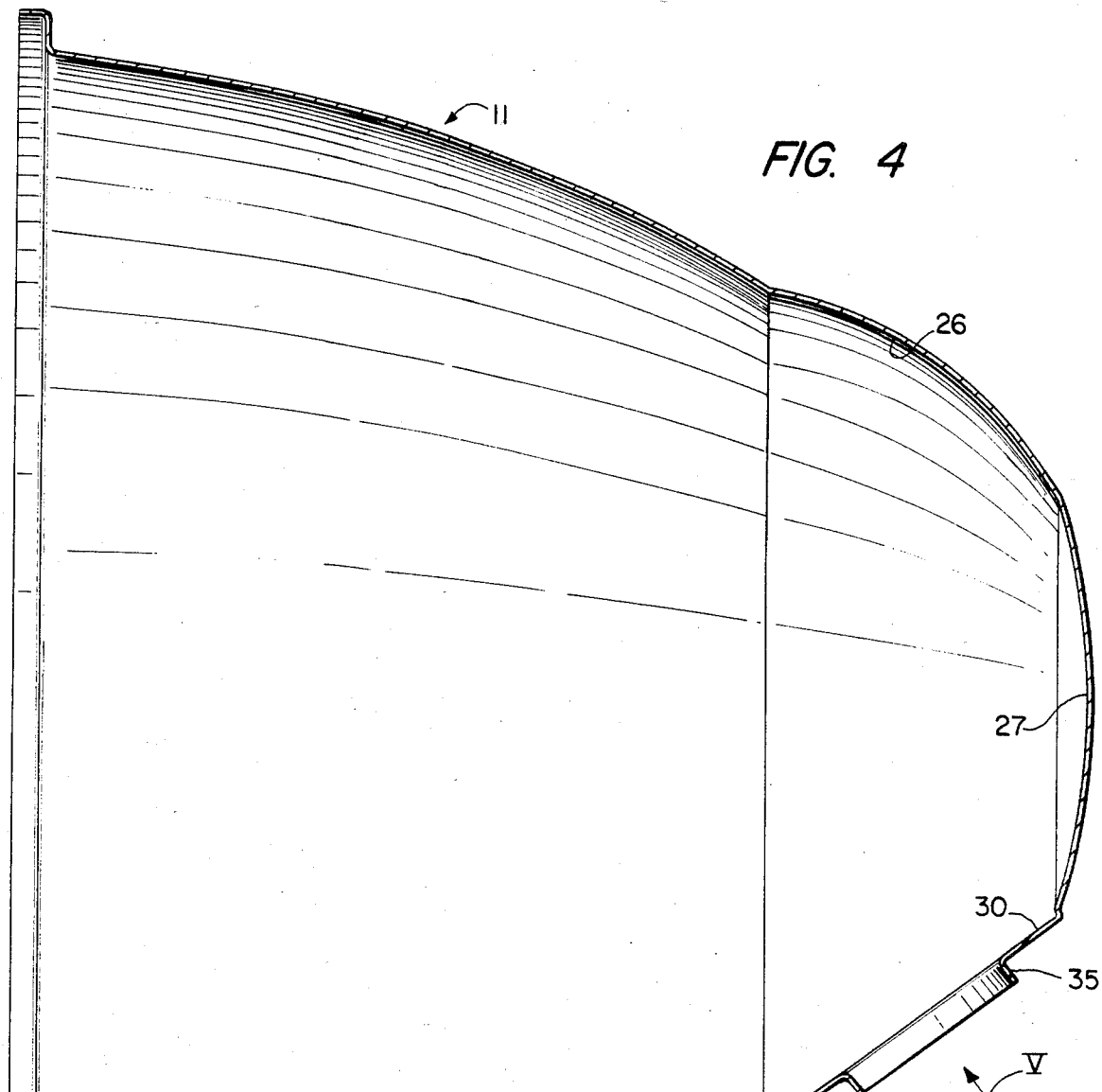
FIG. 4 is an enlarged side elevation in section, of the reflector portion of the luminaire of FIGS. 1 and 2.

Turning now to the drawings, an advantageous first embodiment of a luminaire incorporating the principles of the invention is shown in FIGS. 1 and 2 wherein a high intensity lamp 10 is mounted within a reflector indicated generally at 11, the reflector and lamp being supported on a housing indicated generally at 12. The housing includes a wiring compartment 13 which also contains, at its lower end, a conventional socket of a size to receive the lamp base, commonly a mogul mounting. Wiring compartment 13 is fixedly attached to a ballast housing 14 which contains the conventional circuit elements required to operate a lamp such as lamp 10. In some forms, the lamp does not require a ballast of a size requiring a separate housing, in which case housings 13 and 14 can be merged into one. A generally U-shaped yoke 16 extends rearwardly from housing 14 and is pivotally attached thereto by pivot screws 17 which extend through the ends of the yoke and into the housing. Screws 17 can be selected to provide a clutch type of frictional engagement with the yoke so that the luminaire housing can be adjusted but will remain in position when left alone. Alternatively, the screws can be used as a locking mechanism so that when the lamp is placed in the desired position the screws can be tightened, preventing further movement.

A generally semicircular plate 18 can be provided at one or both sides of housing 14, the plate having an arcuate slot 19 therein to receive a pin 20. Plate 18 also has a laterally protruding finger 21 which can be engaged to position yoke 16. Thus, the plate can provide a pre-position stop which permits establishment of a predetermined desired aiming angle for the luminaire. After maintenance, such as the replacement of a lamp, which may involve moving the assembly from its preferred aiming position, the assembly can be returned quickly to the desired aiming angle without going through a full determination of what the proper aiming angle should be.

As seen generally in FIGS. 1 and 2, the reflector itself is formed so that most of the reflector wall follows a surface of revolution or, more accurately, a sequence of surfaces of revolution, but a portion thereof is formed with a flat mounting surface which engages the bottom of wiring housing 13.

As previously indicated, metal halide lamps are commonly designed so as to have a preferred mounting angle, either base-up or base-down, within which angle the lamp orientation should be maintained. This is illustrated by the angles A on either side of vertical through which the lamp can be moved without significantly impairing its operating characteristics. The reflector is designed with its flat mounting portion at one side, holding the reflector at a constant angle with respect to housing 13 and the mounting socket for the lamp and, therefore, at a fixed angle relative to the central axis of lamp 10. Thus, as shown in FIG. 3, as the luminaire assembly is moved up and down through ± angle A, the aiming direction of the overall luminaire is positioned at an angle (B±A) with respect to the horizontal. This provides the lateral aiming which permits a plurality of such luminaire assemblies to be positioned around the periphery of a sports arena, for example, providing side lighting in addition to more conventional central ceiling mountings which provide downwardly directed light. As will be recognized, yoke 16 can be positioned so that it extends upwardly with respect to housing 14 rather than laterally, or at any position in between, the initial positioning of the yoke being a matter of convenience so that the structure can be mounted on any available surface.

Figure 5:
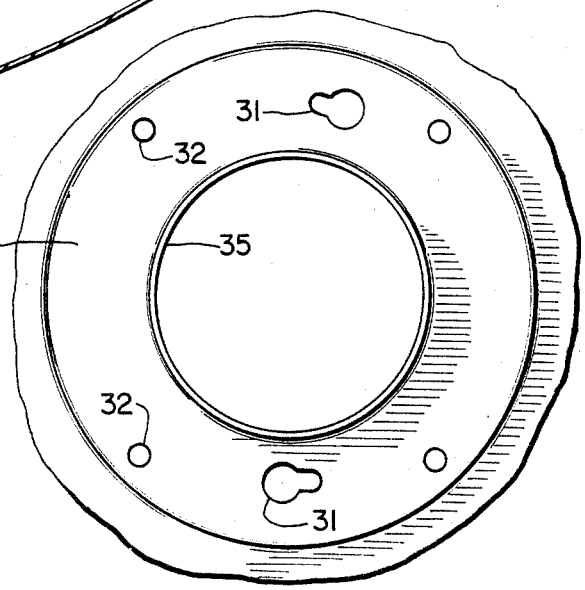
FIG. 5 is a partial view of the mounting area of the reflector of FIG. 4 in the direction of arrow V.

The reflector itself is shown in greater detail in FIGS. 4 and 5. As seen in FIG. 4, the reflector has an open end and an interior reflective surface with a first portion 25 which is smooth and parabolic. The axis of the parabola is preferably 30° above and away from the center line of the reflector, and the focus of the parabola is at the position which will be occupied by the light center of the lamp. The location of the axis is chosen so that even distribution of the light is attained, and approximately 38% of the output of a point source of light located at the focus would be reflected outwardly from the first wall portion 25.

.The second portion 26 is spherical, except for the mounting region, with the center of the sphere being located at the lamp center. Most of the light from this spherical portion reflects from portion 25 before its leaves the reflector.

Finally, the closed end wall 27 of the reflector is parabolic with the axis being along the center line of the reflector and with the focus, again, at the lamp center. The light reflected from this section of the reflector aids in filling the center of the distribution region. About 16% of the output of a point source located at the focus reflects from portion 27.

As seen in FIG. 4, one side of portion 26 is formed with a flat, generally circular area 30, also seen in FIG. 5, portion 30 having diametrically opposite keyhole openings 31 for quick mounting of the reflector on retaining screws in housing 13. Openings 32 are provided for additional fastening screws, if desired.

The center of portion 30 is formed with a relatively short outwardly extending annular wall 35 defining the opening through which the lamp extends. Wall 35 can be received in housing 13 surrounding the socket for easy positioning of the reflector.

As seen in FIG. 4, the open end of the reflector is formed with an annular flange 37 which is designed to receive a clear tempered glass plate or lens of a generally conventional type. Although not illustrated in detail, such a plate is normally mounted in a retaining ring which is hinged at 38 (FIG. 1), the plate being retained in the end of the reflector by mounting latches 39, also conventional.

Figure 6:
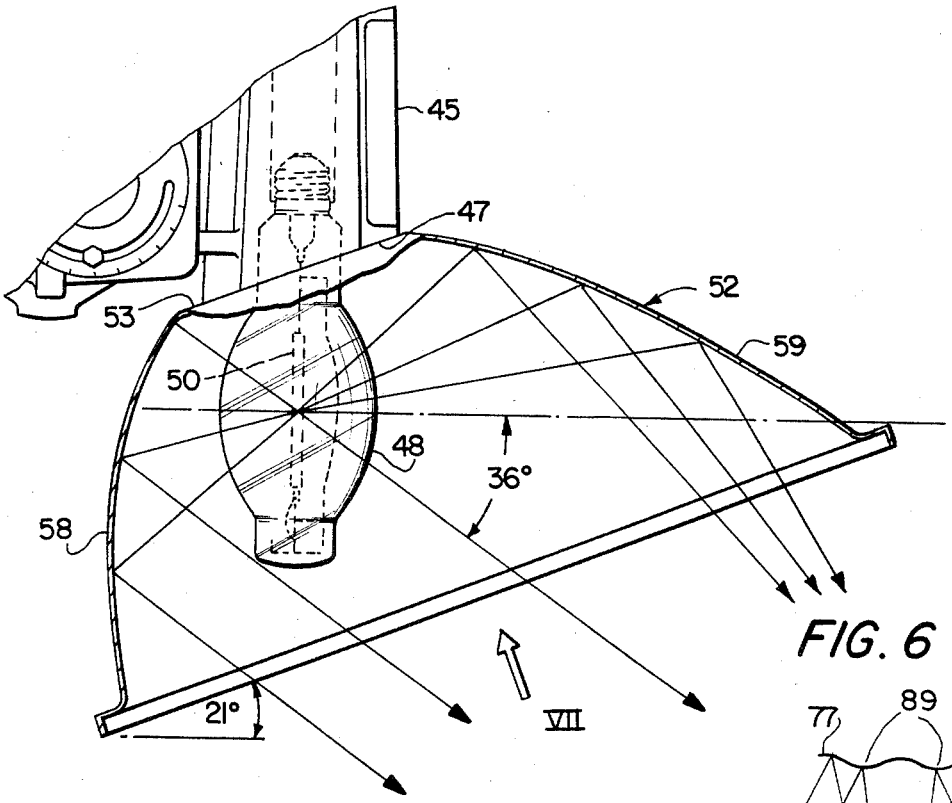
FIG. 6 is a partial side elevation in partial section of a second embodiment of a reflector and mounting in accordance with the present invention.
Figure 7:
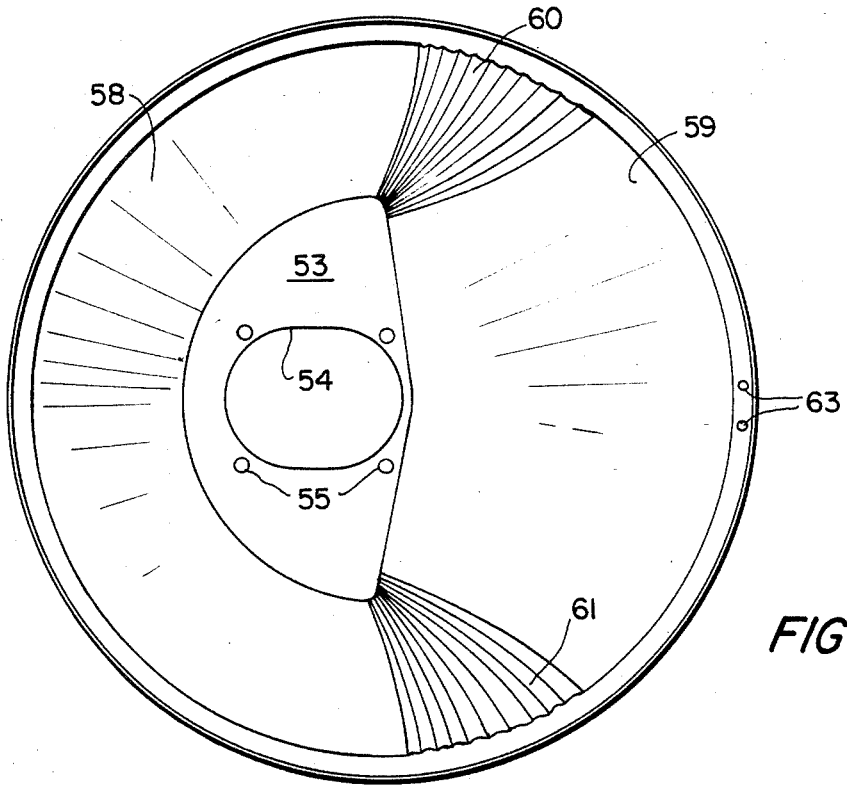
FIG. 7 is a bottom plan view in the direction of arrow VII of the reflector of FIG. 6.

A further embodiment of a reflector and mounting arrangement is shown in FIGS. 6 and 7, FIG. 6 showing a ballast housing 45 which is similar to housing 13 of the embodiment of FIGS. 1 and 2 except for having a lower mounting surface 47 which is inclined at an angle of about 21° relative to the central axis of the housing. The remaining aspects of the housing are the same and will not be described again. Housing 45 contains a socket to receive the base of a lamp 48 which is illustrated as having an elongated light source arc portion 50 with light rays being schematically illustrated as emanating from the center of this source although it will be realized that light also emerges from a greater region of the source than just the center.

A reflector 52 has a flat portion 53, also seen in FIG. 7 apart from the lamp and housing, which has an opening 54 through which the lamp can be inserted into the housing, and fastener holes 55 to attach the reflector to the ballast housing.

The reflector 52 is formed with a rear portion 58 which is a parabolic surface of revolution with the axis of the parabola being inclined at an angle of 54° relative to vertical and to the longitudinal axis of the lamp. The reflector also has a front portion 59, the inner surface of which is an elliptical surface of revolution having one focus at the center of the light source and the second focus displaced forward of the nadir of the reflector. As will be seen from the schematically illustrated light rays, the light is reflected from the parabolic portion 58 at an angle of about 36° from the horizontal (or 54° from vertical) when the lamp axis is vertical and the light reflected from elliptical portion 59 is directed toward a conjugate focus outside of the reflector itself.

Between portions 58 and 59 are transition regions 60 and 71 comprising a plurality of flutes to form a relatively smooth transition between the two surfaces of revolution.

In many floodlighting applications, luminaires are aimed so that the primary light projection axis of the luminaire is at an angle of about 30° to about 45° below horizontal. The luminaire illustrated in FIGS. 6 and 7 is arranged so that the primary projection axis is approximately 36° below horizontal when the axis of lamp source 50 is vertical. 36° being approximately the average aiming angle, this arrangement provides the desired illumination with minimum up and down adjustment. It will also be observed that the front or upper portion of the reflector edge is provided with openings 63 to which a cover such as that described in connection with FIGS. 1-3 can be attached as by a hinge 38, not shown in FIGS. 6 and 7. The advantage of hinging the cover at the upper, front edge is that the cover will then not encounter a pole or vertical wall if the luminaire is mounted adjacent such a vertical surface when the lamp is being replaced. Additionally, since the cover is facing primarily downwardly, it is more effectively shielded from rain, snow and the like.

Figure 10:
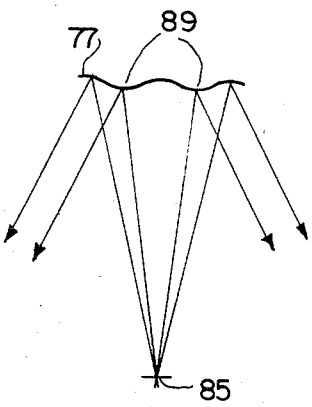
FIG. 10n is a schematic partial sectional view showing the fluted portion of the reflector of FIGS. 8 and 9.
Figure 8:
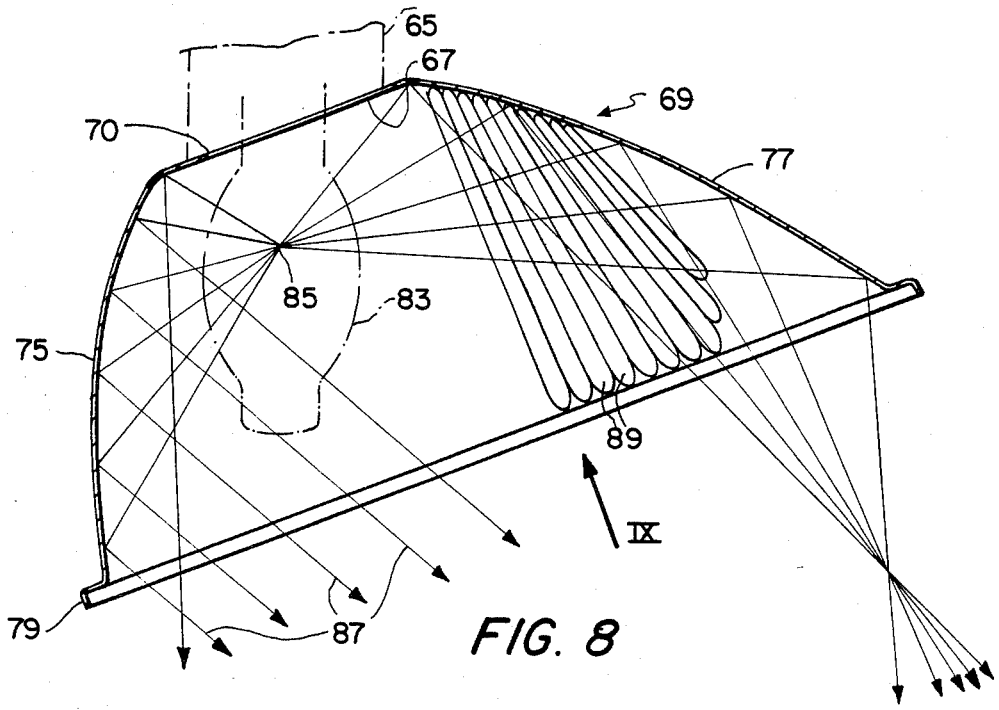
FIG. 8 is a partial side elevation in partial section of a third embodiment of a reflector and mounting arrangement in accordance with the present invention.
Figure 9:
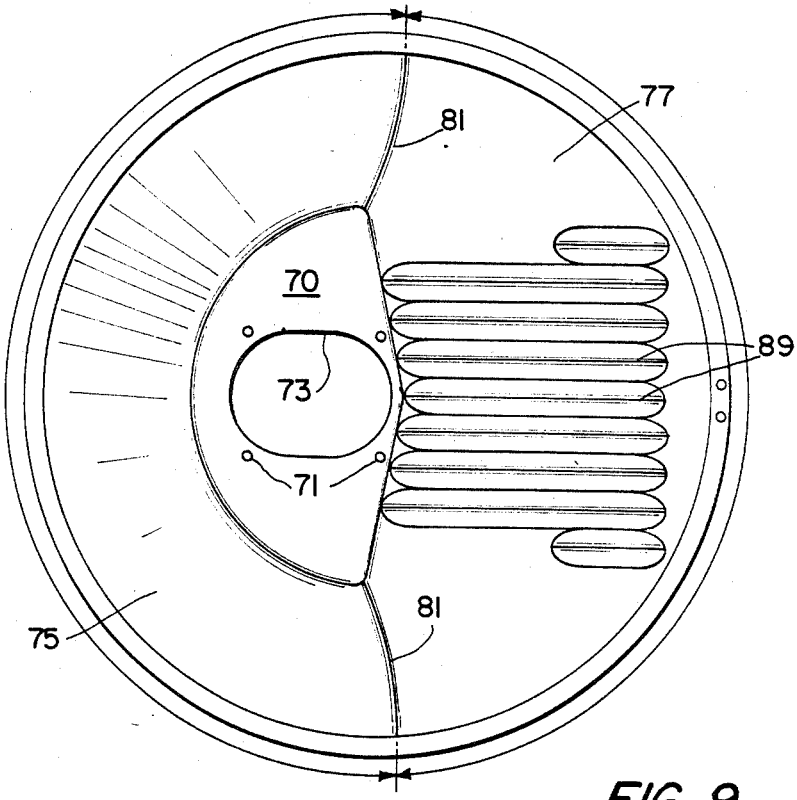
FIG. 9 is a bottom plan view in the direction of arrow IX of the reflector of FIG. 8.

A third embodiment of a reflector in accordance with the invention is shown in FIG. 8, 9 and 10, the reflector shown therein being mounted on a housing 65 which is substantially identical to housing 45, having an inclined lower mounting surface 67. The reflector, indicated generally at 69, has a flat portion 70 for mounting against surface 67 using mounting holes 71 and an opening 73 through which a lamp can be inserted into a socket contained within housing 65. The reflector in this embodiment has a rear portion 75 and a front portion 77, the two portions terminating in a circular rim 79 and meeting at a transition line 81 on each side of the reflector. As indicated by the arrows in FIG. 9, each of the front and rear portions occupies approximately one-half of the overall circular extent of the reflector, although the area of portion 77 is perhaps slightly larger.

The lamp, schematically indicated at 83 in FIG. 8, has an elongated arc as before with the center of the arc being indicated at 85. The long axis of the arc is again 21° separated from the plane containing the open end of the reflector and surface 67, the axis of the lamp defining the "normal" vertical orientation of the structure. Thus, the circular opening is inclined above horizontal by 21° in a normal mounting situation.

Rear portion 75 is a parabolic surface of rotation having an axis at an angle of approximately 55° relative to the axis of the lamp arc. The light energy emitted by the arc is reflected, according to known laws of reflectance in a direction parallel with the axis of the parabola, creating a concentrated beam of light from that portion of the reflector which is approximately 55° forward of vertical, this beam being schematically indicated by lines 87. Due to the elongation of the arc, the beam is spread by the included angle defined by the ends of the arc and the intersection with the axis of the parabola, the lines shown being those from the light center.

The front portion 77 of the reflector has a reflective surface which is elliptical having one focus at the arc center and the conjugate focus disposed ahead of the center line of the opening of the reflector. The result of this is to provide light energy from the nadir point below the fixture to the aiming point.

In addition, front portion 77 is provided with a plurality of flutes 89 to create a degree of lateral dispersion which is illustrated by the partially schematic sectional view of FIG. 10 which is taken across several flutes 89. As will be seen, light from source 85 is dispersed to the left and right which, in FIG. 9, would be in the upward and downward direction. This provides additional width to the portion of the beam which is reflected from the front of the reflector.

The embodiment of FIGS. 8-10 has been found to be particularly effective and efficient in illuminating areas such as recreational fields and arenas and, as with the mounting of the previously described embodiment is capable of adjustment throughout the normal ranges of required illumination without exceeding the angular range of greatest efficiency for the arc source of a metal halide lamp.

While one advantageous embodiment has been chosen to illustrate the invention, it will be understood by those skilled in the art that various changes and modifications can be made therein without departing from the scope of the invention as defined in the appended claims.

What is claimed is:

1. An improved luminaire for use with high intensity discharge lamps, the luminaire being of the type having a housing, a mounting bracket coupled to said housing, lamp mounting means on said housing for receiving a lamp with the central axis of the lamp in a predetermined relationship to said mounting means and housing and an open-ended reflector attached to said housing, said housing being angularly adjustable relative to said mounting bracket to thereby adjust the inclination of the axis of said lamp, the improvement wherein said reflector has a wall formed such that the interior reflective surface thereof defines first and second distinct surfaces of revolution which are different from each other, each surface occupying about one-half of the internal circumference of the reflector, the two surfaces being separated by transition regions extending from said means for attaching to said open end, said first of said surfaces comprising a parabola having a central axis at an angle of about 54° relative to the longitudinal axis of said lamp; and said second of said suraces following an elliptical surface of revolution having one focus at the center of said lamp, said second of said surfaces being fluted;

and wherein said reflector further comprises means defining an opening in said reflector through which a lamp can extend from said lamp mounting means into said reflector; and means around said opening for attaching said reflector to said lamp mounting means.

* * * * *